US009908121B2

(12) United States Patent
Forsberg et al.

(10) Patent No.: US 9,908,121 B2
(45) Date of Patent: Mar. 6, 2018

(54) HORIZONTAL SHAFT IMPACT CRUSHER HAMMER LIFTING DEVICE

(71) Applicant: SANDVIK INTELLECTUAL PROPERTY AB, Sandviken (SE)

(72) Inventors: Andreas Forsberg, Malmo (SE); Knut Kjaerran, Svedala (SE); Rowan Dallimore, Bath (GB)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/319,795

(22) PCT Filed: Jun. 19, 2014

(86) PCT No.: PCT/EP2014/062965
§ 371 (c)(1),
(2) Date: Dec. 18, 2016

(87) PCT Pub. No.: WO2015/192906
PCT Pub. Date: Dec. 23, 2015

(65) Prior Publication Data

US 2017/0136469 A1 May 18, 2017

(51) Int. Cl.
*B02C 13/26* (2006.01)
*B66C 1/24* (2006.01)

(52) U.S. Cl.
CPC ..... *B02C 13/26* (2013.01); *B66C 1/24* (2013.01); *B02C 2013/29* (2013.01)

(58) Field of Classification Search
CPC ..... B66C 1/105; B66C 1/107; B66C 1/24; B66C 1/62; B66C 1/66; B02C 13/26; B02C 13/28; B02C 2013/29
USPC ..... 294/67.2, 67.21, 67.22, 67.31, 67.5; 241/192; 414/783
See application file for complete search history.

(56) References Cited

U.S. PATENT DOCUMENTS 2,348,309 A * 5/1944 Rohr ..... B66C 1/10 294/67.5
2,368,947 A * 2/1945 Smith ..... B66C 1/10 294/67.5
3,696,487 A * 10/1972 Mrugala ..... B24B 45/003 294/67.22
3,998,488 A * 12/1976 Durgan ..... B66C 1/10 294/67.21
5,005,772 A 4/1991 Ostergaard
5,092,529 A * 3/1992 Bechler ..... B02C 13/28 241/192
5,791,861 A * 8/1998 Seelig ..... B65G 47/91 212/276

(Continued)

FOREIGN PATENT DOCUMENTS

DE 19512170 A1 10/1996
FR 2418769 A1 9/1979
GB 2120997 A 12/1983

(Continued)

*Primary Examiner* — Dean J Kramer
(74) *Attorney, Agent, or Firm* — Corinne R. Gorski

(57) ABSTRACT

A crusher hammer lifting device facilitates raising and lowering of a hammer mountable at a rotor of a horizontal shaft impact crusher (HSi-crusher). The device includes a main body, a mount engager for attachment to an auxiliary lifting tool and a hammer attachment for releasably mounting the hammer in a rotatable manner at the device.

12 Claims, 5 Drawing Sheets

(56) References Cited

U.S. PATENT DOCUMENTS 6,578,892 B2 * 6/2003 Tsimmerman ..... B66C 1/107
294/67.21

FOREIGN PATENT DOCUMENTS

| | | | |
|---|---|---|---|
| WO | 2010071550 | A2 | 6/2010 |
| WO | 2011129744 | A1 | 10/2011 |
| WO | 2013189687 | A1 | 5/2013 |
| WO | 2013189691 | A1 | 12/2013 |

* cited by examiner

HORIZONTAL SHAFT IMPACT CRUSHER HAMMER LIFTING DEVICE

RELATED APPLICATION DATA

This application is a § 371 National Stage Application of PCT International Application No. PCT/EP2014/062965 filed Jun. 19, 2014.

FIELD OF INVENTION

The present invention relates to a lifting device to facilitate mounting and dismounting hammer parts at a rotor of a horizontal shaft impact crusher (HSi-crusher) and in particular although not exclusively, to a lifting device to releasable attach and suspend the hammer part at a lifting tool such as a crane.

BACKGROUND ART

Horizontal shaft impact crushers (HSi-crushers) are utilized in many applications for crushing hard material, such as pieces of rock, ore etc. A HSi-crusher comprises a crushing chamber housing an impeller (alternatively termed a rotor) that is driven to rotate about a horizontal axis. Pieces of rock are fed towards the impeller and are struck by impeller mounted hammer elements. The rock pieces are disintegrated initially by striking contact with the hammer elements and are then accelerated and thrown against breaker plates (typically referred to as curtains) to provide further disintegration. The action of the impeller causes the material fed to the horizontal shaft impact crusher to move freely in the chamber and to be crushed upon impact against the hammer elements, against the curtains, and against other pieces of material moving around at high speed within the chamber. Example HSi-crushers are described in WO 2010/071550; WO 2011/129744; WO 2011/129742; WO 2013/189691 and WO 2013/189687.

Conventionally, the hammer wear parts are interchanged at the impeller via lifting engagers that are brought into position horizontally at the sides of each hammer. Such an arrangement is often problematic as access to the sides of the elongate hammers is restricted. Additionally, due to the appreciable size and weight of the hammer elements interchange at the impeller carries significant health and safety risks as it is typically required to manually manipulate the hammers into or from their impeller mounted position. Accordingly it is not uncommon for operator fingers to become trapped during installation and removal. What is required therefore is apparatus that facilitates mounting and dismounting of hammer elements at a HSi-crusher that addresses the above problems.

SUMMARY OF THE INVENTION

It is an objective of the present invention to facilitate mounting and dismounting crusher hammer elements at an impeller of a HSi-crusher. It is a further specific objective to provide a lifting device for a crusher hammer that is capable of being suspended from an auxiliary lifting tool such as a crane and the like and configured to allow a hammer part to be manipulated and in particular rotated at the lifting device during mounting and dismounting procedures. It is a further objective to reduce and eliminate, as far as possible, the health and safety risks by which operating personnel are exposed during hammer mounting and dismounting procedures so as to avoid specifically injuries to an operator's hands and fingers. It is yet a further objective to enable hammer parts to be raised and lowered substantially vertically at a HSi-crusher to avoid or minimise a need for access to the lateral sides of the crusher during such procedures.

The objectives are achieved via a crusher hammer lifting device that may be suspended conveniently from an auxiliary lifting tool such as a crane to releasably engage a crusher hammer and to provide an intermediate suspended mounting assembly for releasably attaching the hammer part to the auxiliary lifting tool. The present lifting device is generally elongate to allow convenient introduction into the HSi-crusher chamber from immediately above such that a hammer part can be raised and lowered vertically relative to the crusher rotor. Such an arrangement is advantageous to avoid a need for access to lateral sides of the crusher and in particular to dismantle or remove parts of the crusher that would otherwise be required to introduce the hammer parts from a sideways position.

Advantageously, the present device comprises a hammer attachment rotatably mounted at a main body of the device to allow a hammer part, once attached to the device to be held in a rotatable suspended position such that an operator may rotate the hammer part about an axis aligned transverse or perpendicular to the vertical (upward and downward) lifting direction by which the hammer part is introduced to or removed from the crusher rotor.

According to a first aspect of the present invention there is provided a crusher hammer lifting device to facilitate raising and lowering a hammer mountable at a rotor of a horizontal shaft impact crusher, the lifting device comprising: a main body having a first end and a second end; a mount engager positioned at or towards the first end of the main body to engage and allow the device to be suspended from a lifting tool; a hammer attachment positioned at or towards the second end of the main body to releasably attach the hammer to the device; an axle rotatably mounting the attachment at the main body such that a hammer when attached to the device may be rotated about an axis of the axle relative to the main body.

Preferably, the main body is elongate and the axis of the axle is aligned transverse including perpendicular to a length of the main body. Such a configuration is advantageous to vertically separate the end of the device that is attached to the auxiliary lifting tool and the attachment that mounts the hammer part at the second end of the main body. The present device therefore may be manipulated conveniently in a vertical direction to access the crusher rotor positioned towards the lower region of the HSi-crusher.

Optionally, the device comprises a lock mechanism movably mounted at or towards the second end of the main body to lock the axle and the attachment in a non-rotatable fixed position at the main body. The lock mechanism allows personnel to move the hammer part between rotational positions and to lock the hammer part at fixed rotational positions as desired.

Preferably, the lock mechanism comprises a flange extending radially outward from the axle. Optionally, the flange comprises a wheel releasably mounted at the axle via a pivot or releasable mounting. The flange is dimensioned with a substantially planar body so as to be positioned in close proximity to one side of the main body. Preferably, the attachment is provided at one side of the main body and the flange is provided at an opposite side of the main body. The flange and the attachment are separated substantially by the full length of the axle with the flange being rigidly mounted at the axle. An operator is capable of rotating the hammer part about the axis of the axle by holding and rotating the hammer part with the one hand and optionally the flange with the other hand.

Preferably, the lock mechanism further comprises a lever pivotally mounted at the main body to engage in touching contact at a part of the flange so as to rotatably lock the axle and the attachment at the main body. The lever is sized to be conveniently grasped by a hand of an operator and moved between a first non-engagement and a second engagement position to release and rotatably lock the flange respectively at the main body.

Preferably, the flange comprises a plate like body having at least a first pair of notches recessed into a perimeter of the flange, the lever pivotally mounted to releasably engage into one of the notches to rotatably lock the axle and the attachment at at least two rotational positions. The substantially planar flange plate may be circular, oval, elongate or comprise a polygonal shape profile to facilitate optional grasping by the hand of personnel.

Optionally, the flange comprises two notches positioned at diametrically opposite regions of the flange. Optionally, the notches are formed as radially extending recesses indented to extend radially inward from the perimeter of the flange so as to extend radially towards the axis of the axle. A width of each respective slot is greater than a corresponding width of the lever so as to receive at least a part of the lever when moved into engaging contact with the flange.

Optionally, the mount engager comprises any one of: an eyelet formed within a fin extending laterally from one side of the main body; a hook extending laterally from one side of the main body; a projection extending laterally from one side of the main body. Accordingly, the device may be releasably suspended from an auxiliary lifting tool and in particular releasably attached to one end of a chain, belt or cable system either directly or via intermediate couplings releasably attached to the mount engager. Preferably, the mount engager is positioned at the same side of the main body as the hammer attachment such that the hammer part is mounted vertically below the mount engager. Such a configuration is advantageous such that the elongate main body is aligned substantially vertically when the hammer part is suspended from the device and the auxiliary lifting tool. In this configuration, a plane of the flange is also aligned substantially vertically. This configuration greatly facilitates the rotation of the hammer part by manipulation of the flange. In particular, a respective distance by which the part of the mount engager (that is contacted by the auxiliary lifting tool) extends laterally from the main body is configured such that the mass centre of the hammer part is positioned vertically below the engaging end of the auxiliary lifting tool by which the device is suspended.

Preferably, the attachment comprises a plate like body mounted at one end of the axle and having at least a pair of holes to receive bolts for attaching the hammer to the attachment. More preferably, the attachment comprises at least a first pair of holes for mounting the hammer at a first position at the attachment and at least a second pair of holes for mounting the hammer at a second position at the attachment. Such a configuration is advantageous to mount correctly hammer parts of symmetrical and non-symmetrical configurations at the attachment device. In particular, following use, the impact edge of the hammer is eroded to effectively reduce the width of the hammer part. Accordingly, the first and second set of holes are provided such that the mass centre of the hammer is correctly aligned at the axis of the axle. Such a configuration greatly facilitates rotation of the hammer part when suspended.

Optionally, the main body comprises an axle mount at or towards the second end of the main body to receive and rotatably mount the axle and the attachment at the main body. The axle may be mounted at the main body via an axle mount bore with the axle mounted directly and rotatable within the bore. Optionally, the device may further comprise a bearing assembly to rotatably mount the axle at the main body. Accordingly, the device may further comprise suitable seals and gaskets for any such bearing assembly.

Optionally, the lever is elongate having a first end and a second end, the first end of the lever mounted at one side of the main body via a pivot mount such that the second end of the lever extends through the main body to project laterally at an opposite side of the main body.

According to a second aspect of the present invention the lifting device may comprise a crusher hammer releasably attached to the device, the hammer comprising one or a plurality of threaded boreholes to receive attachment bolts releasably attaching the hammer to the attachment device.

Preferably, the hammer comprises a pair of threaded bore holes to mount the hammer at the attachment. Preferably, the hammer comprises a pair of threaded bore holes and the attachment comprises two mounting positions for the hammer. The present lifting device and hammer are therefore configurable as an assembly that may be raised and lowered vertically at a HSi-crusher via an auxiliary lifting tool.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
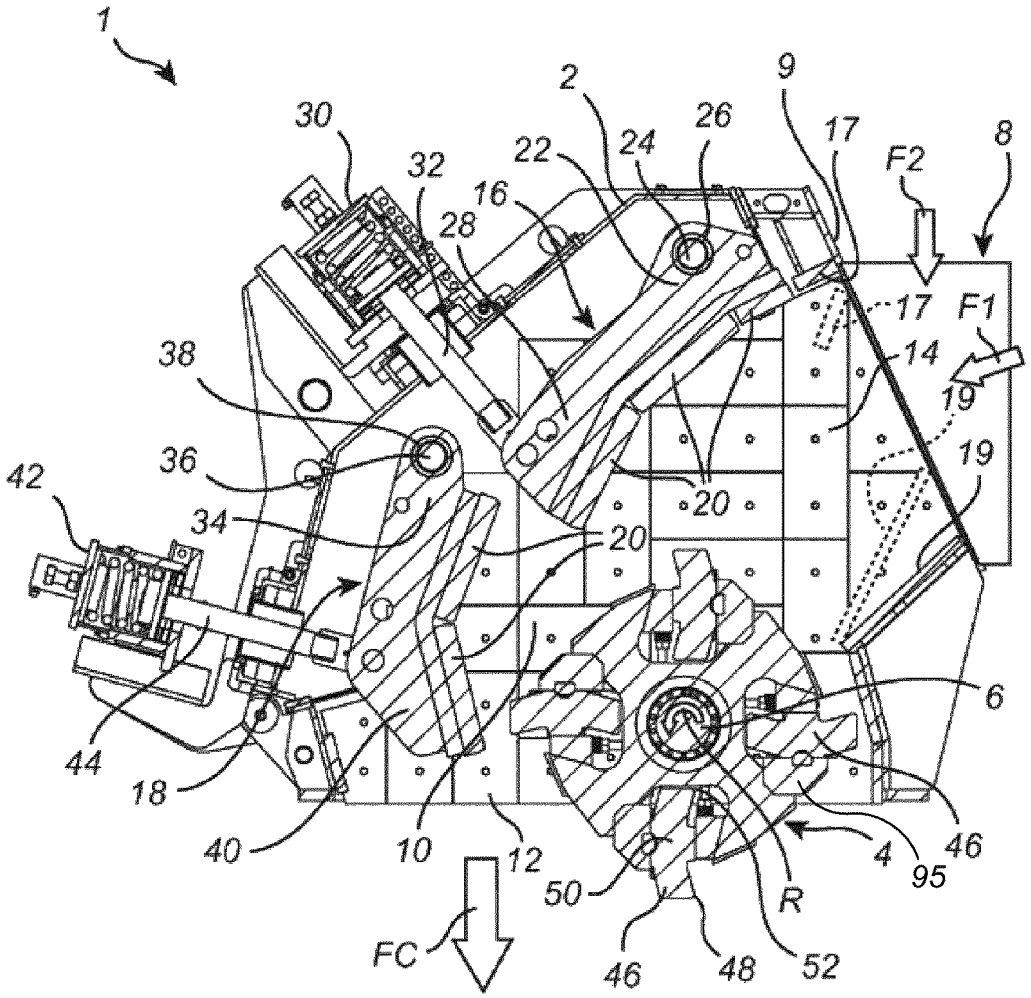
FIG. 1 is cross-sectional side view of a horizontal shaft impact crusher comprising a plurality of replaceable hammer elements releasably engageable with a lifting device according to a specific implementation of the present invention.

Referring to FIG. 1 a horizontal shaft impact crusher 1 (HSi-crusher) comprises a housing 2 in which an impeller indicated generally by reference 4 is rotatably mounted. A motor, (not illustrated) is operative for rotating a horizontal shaft 6 on which the impeller 4 is mounted. As an alternative to impeller 4 being fixed to shaft 6, impeller 4 may rotate around shaft 6. In either case, impeller 4 is operative for rotating around a horizontal axis, coaxial with the centre of shaft 6.

Material to be crushed is fed to a feed chute 8, which is mounted to an inlet flange 9 of housing 2, and enters a crushing chamber 10 positioned inside the housing 2 and at least partly enclosing impeller 4. Material crushed within the crusher 1 exits the crushing chamber 10 via a crushed material outlet 12. Housing 2 is provided with a plurality of interior wear protection plates 14 operative for protecting the interior of crushing chamber 10 from abrasion and impact by the material to be crushed.

Crusher 1 comprises a first curtain 16, and a second curtain 18 arranged inside crushing chamber 10. Each curtain 16, 18 comprises at least one wear plate 20 against which material may be crushed. A first end 22 of first curtain 16 is mounted via a horizontal first pivot shaft 24 extending through an opening 26 formed in curtain 16 at the first end 22. First pivot shaft 24 extends further through openings in the housing 2 to suspend the first end 22 in the housing 2. A second end 28 of first curtain 16 is connected to a first adjustment device 30 comprising at least one adjustment bar 32. A first end 34 of second curtain 18 is mounted by means of a horizontal second pivot shaft 36 extending through an opening 38 formed in curtain 18 at first end 34. Second pivot shaft 36 extends further through openings in the housing 2 to suspend the first end 34 in the housing 2. A second end 40 of second curtain 18 is similarly connected to a second adjustment device 42 comprising at least one adjustment bar 44.

Impeller 4 is provided with four hammer elements 46 according to the specific embodiment, with each element 46 having a generally curved or 'banana'-like shape profile, when view in cross-section. An arrow R indicates the rotational direction of impeller 4. A leading edge 48 of each respective hammer element 46 extends in the direction of rotation R. Prior to extended use, hammer element 46 is symmetric around a central portion 50. However, once leading edge 48 has been worn element 46 can be turned and mounted with its second leading edge 52 operative for crushing material.

The HSi-crusher 1 can be adjusted to a first crushing setting, which for example may be a primary crushing setting, for crushing large objects (typically having a maximum particle size of 300-1200 mm), and a second (or secondary) crushing setting being different from the first setting for crushing intermediate size objects (having a maximum particle size of less than 400 mm and typically 20-400 mm). When crusher 1 is operated in the primary setting the crushed material exiting crusher 1 via the outlet 12 would typically have an average particle size of 35-300 mm, and typically at least 75% by weight of the crushed material would have a particle size of 20 mm or larger. When crusher 1 is operated in the secondary setting the crushed material leaving the crusher 1 via the outlet 12 would typically have an average particle size of 5 to 100 mm, and typically at least 75% by weight of the crushed material would have a particle size of 5 mm or larger. Within the present specification the 'average particle size' refers to weight based average particle size.

Adjusting crusher 1 to the primary crushing setting would typically involve retracting the first and/or second curtains 16, 18 away from impeller 4, to form a crushing chamber 10 having a large volume and a large distance between the impeller 4 and the wear plates 20 of curtains 16, 18. Such retraction of at least one curtain 16, 18 would be performed by operating the first and/or second adjustment devices 30, 42, which may typically involve hydraulic cylinders and/or mechanical adjustment devices using threaded bars. Adjusting the crusher 1 to the secondary crushing setting would, on the other hand, typically involve moving the first and/or second curtains 16, 18 towards the impeller 4 by means of operating the first and/or second adjustment devices 30, 42, to create a crushing chamber 10 having a small volume and a short distance between the impeller 4 and the wear curtain plates 20. In addition to adjusting the position of the curtains 16, 18, the horizontal shaft impact crusher feed chute 8 is adjusted to feed the material into the crushing chamber 10 in a first direction F1 when crusher 1 is adjusted to the primary setting, and in a second direction F2 when crusher 1 is adjusted to the secondary setting. Hence, the first crushing setting is different from the second crushing setting. Furthermore, the first direction F1 of feeding material to the crusher 1 is different from the second direction F2 of feeding material to the crusher 1.

The adjustment of the HSi-crusher 1 from a primary crushing setting to a secondary crushing setting may also involve adjusting the positions of an upper feed plate 17 and a lower feed plate 19 that are located just inside of the inlet flange 9 of the housing 2 of the crusher 1. The feed plates 17, 19 protect the inlet of the housing 2, and provide the material fed to housing 2 with a desired direction. In FIG. 1, the upper and lower feed plates 17, 19 are adjusted to the primary setting (shown in unbroken lines) with the intention of directing the coarse material towards impeller 4 and the first curtain 16 when the crusher 1 operates in the primary setting. The positions of the upper and lower feed plates 17, 19 in the secondary setting are indicated with broken lines in FIG. 1.

As can be seen the upper and lower feed plates 17, 19 are, in the secondary setting, arranged for directing the material directly towards the impeller 4. In this manner, the rather fine material fed when the crusher 1 operates in the secondary setting will receive more 'hits' from the impeller hammer elements 46 leading to a greater reduction in the size of the material.

In operation material to be crushed is fed to the feed chute 8 and further into the crushing chamber 10, either in the direction F1 if the crusher 1 is adjusted to the primary setting or in the direction F2 if crusher 1 is adjusted to the secondary setting. The material will first reach that part of the crushing chamber 10 which is located adjacent to first curtain 16, being located upstream of the second curtain 18 as seen with respect to the direction of travel of the material. Impeller 4 is rotated at typically 400-850 rpm. When the material is impacted by the impeller elements 46 it will be crushed and accelerated against wear plates 20 of first curtain 16 where subsequent and further crushing occurs. The material will bounce back from first curtain 16 and will be crushed further against material travelling in the opposite direction and then again against the elements 46. When the material has been crushed to a sufficiently small size it will move further down the crushing chamber 10, and will be accelerated, by means of the elements 46, towards wear plates 20 of the second curtain 18, being located downstream of first curtain 16. When the material has been crushed to a sufficiently small size it exits chamber 10 via outlet 12 as a flow of crushed material FC.

Figure 2:
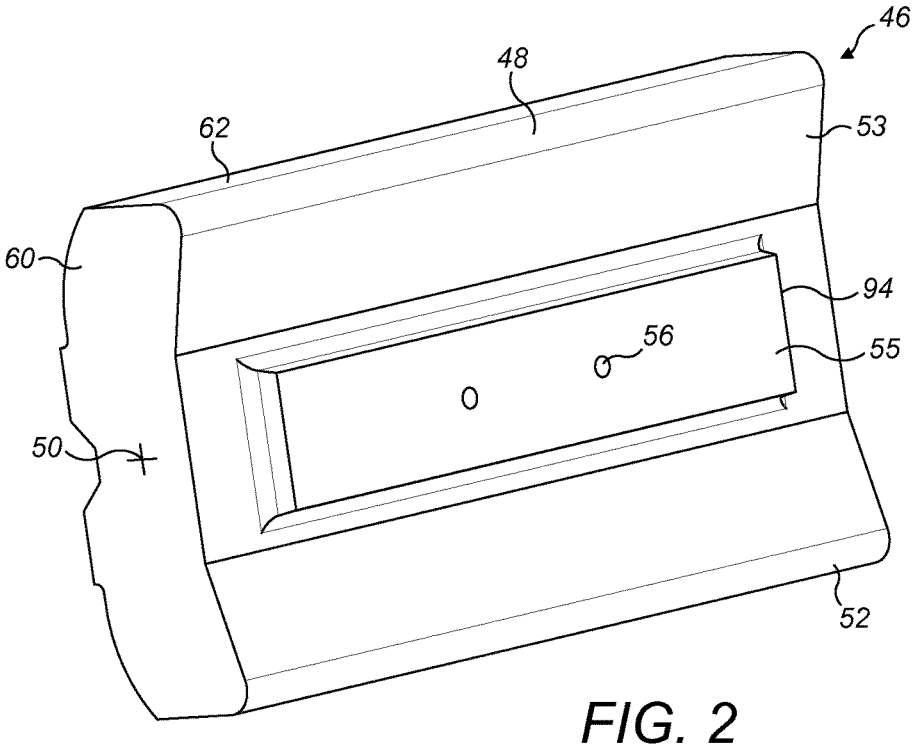
FIG. 2 is a perspective front view of a replaceable hammer element of FIG. 1.
Figure 3:
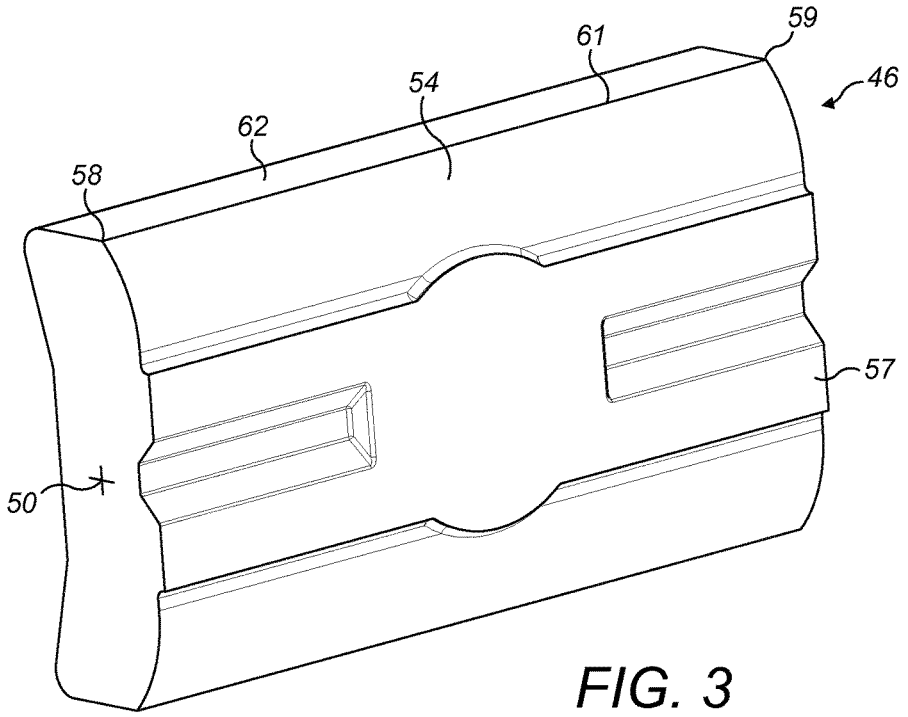
FIG. 3 is a rear perspective view of the hammer element of FIG. 2.

Referring to FIGS. 2 and 3, each hammer element 46 comprises a generally rectangular main body having a main length defined by and extending between a first end 58 and a second end 59. A pair of ends faces 60 extend widthwise at ends 58, 59. The pair of material contact edges 48 and 52 extend lengthwise between end faces 60. Accordingly, element 46 comprises a front face 53 configured for positioning with the rotational direction of impeller 4 so as to represent a leading face. Element 46 further comprises a rear face 54 positioned opposed to the rotational direction of impeller 4 so as to represent a trailing face of element 46. To optimise the crushing performance of element 46, front face 53 is generally concave whilst rear face 54 is generally convex. Accordingly, leading edge 48 represents a forwardmost part of face 53 when element 46 is mounted at impeller 4 via locking wedges 95. Each respective leading edge 48, 52 is generally curved (or rounded) and defines a leading edge of a pair of lengthwise extending side faces 62 with an adjacent trailing edge indicated generally by reference 61.

A generally rectangular mounting projection 94 is positioned at a mid-width position of front face 53 and extends in a lengthwise direction between ends 58, 59. Projection 94 terminates at an exposed substantially rectangular contact surface 55 that is positioned approximately co-planar with each leading edge 48, 52. A pair of threaded bores extend into projection 94 with each bore 56 spaced apart in the lengthwise direction and aligned at the same widthwise position so as to be generally central within contact surface 55.

Rear face 54 also comprises a plurality of raised ridges indicated generally by reference 57 resultant from the casting of element 46 involving the use of 'runners' and 'risers' as will be appreciated by those skilled in the art.

The present lifting device 63 comprises an elongate main body 64 formed from a generally hollow bar having a first end 65 and a second end 66. Main body 64 comprises a first side 88 and a second side 89 positioned at either side of a longitudinal axis 96 extending centrally through main body 64. A fin 67 projects laterally from second side 89 and comprises an eyelet 68 positioned at an outward end 101 of fin 67. A second fin end 69 is mounted at main body 64 via an elongate groove 70 extending axially through main body 64 and having a depth sufficient to accommodate fin end 69. Fin 67 is secured rigidly to main body 64 via welding or suitable attachment pins or bolts (not shown). An axle 80 is rotatably mounted at an axle mounting 87 provided at main body second end 66. Axle 80 extends laterally from both sides 88, 89 to provide a mount for a flange 77 positioned at first side 88 and an attachment bracket 83 positioned at main body second side 89. Flange 77 is rigidly mounted to axle 80 via an axle mount 81 with coupling provided by a mounting bolt 82. Flange 77 comprises a generally disc-like configuration being generally planar with an oval shape profile. A pair of notches or recesses 78, 79 extend radially inward from a perimeter 90 of flange 77. Notches 78, 79 are positioned diametrically opposite one another at respective 'twelve o'clock and six o'clock' positions.

Attachment bracket 83 also comprises a plate-like body having a generally planar configuration. Bracket 83 is generally rectangular with a rearward face of bracket 83 attached rigidly to one end of axle 80 via an axle mount 86 so as to present an outward facing mount face 100 for positioning against hammer contact face 55. Accordingly, mount 86 and bracket 83 are configured for rotation about an axis 97 extending centrally through axle 80. Flange 77, being mounted at one end of axle 80, is rotatably locked with hammer attachment bracket 83 with both components rotatably mounted with respect to main body 64 about rotational axis 97. Accordingly, rotation of flange 77 about axis 97 provides a corresponding rotation of bracket 83 about axis 97.

Bracket 83 comprises a first pair of mount holes 85 spaced apart in a lengthwise direction at bracket 83 between respective lengthwise end edges 98. A second pair of mount holes 91 are also spaced apart in the lengthwise direction between bracket end edges 98 with the first and second pairs of holes 85, 91 spaced apart in the widthwise direction between bracket widthwise end edges 99. Holes 85 are positioned approximately mid-width between widthwise end edge 99 whilst the second pair of holes 91 are positioned closer to one of the widthwise end edges 99 so as to be positioned between the first pair of holes 85 and one end edge 99.

Figure 4:
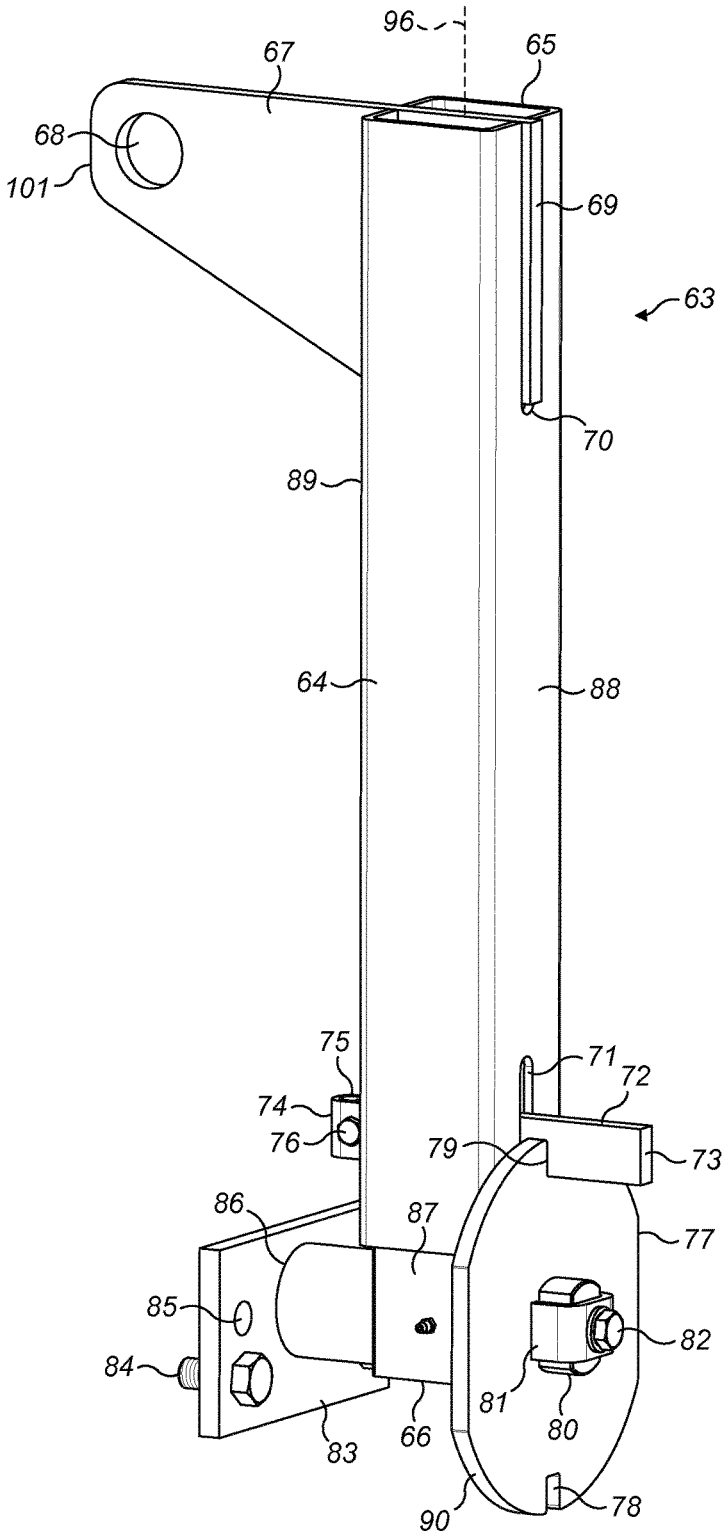
FIG. 4 is a perspective view of a lifting device to allow raising and lowering of the hammer element of FIG. 6 according to a specific implementation of the present invention.
Figure 5:
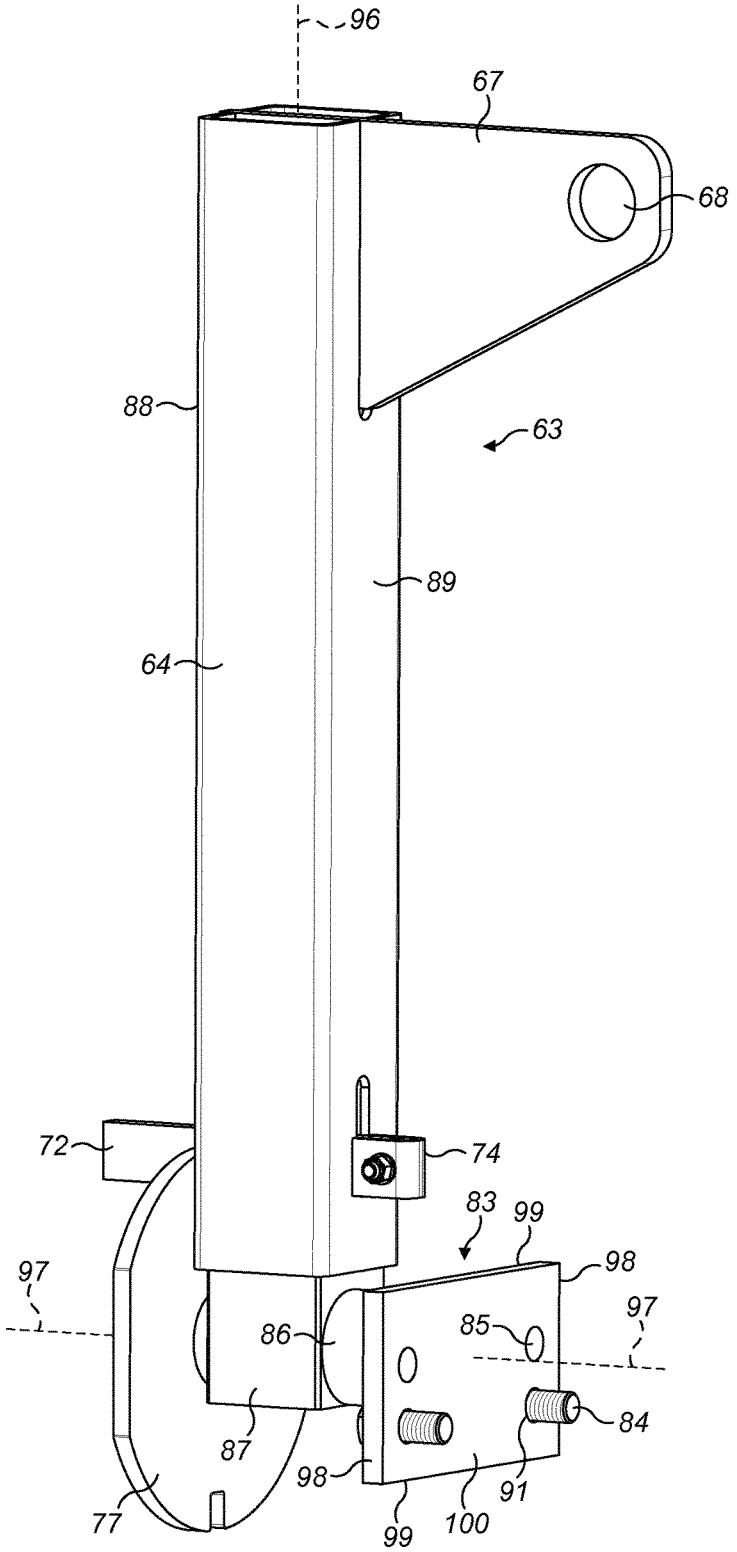
FIG. 5 is further perspective view of the lifting device of FIG. 4.

Main body 64 further comprises an elongate slot 71 extending a short axial distance through sides 88 and 89. A locking lever 72 extends through main body 64 being aligned transverse (including perpendicular) to axis 96 so as to be aligned generally with axle axis 97. Lever 72 projects through slot 71 so as to extend laterally outward from both sides 88, 89. A first lever end 75 is mounted at main body 64 via a pivot mount 74 and a pivot pin 76 extending through mount 74 and lever end 75. Accordingly, a second lever end 73 is capable of pivoting about pin 76 to be moved in the axial direction of main body 64 within slot 71 towards and away from flange 77. In particular, lever 72 is mounted axially to one side of flange 77 such that in a lowered engagement position of FIG. 4, a part of lever 72 is configured for positioning to be received within one of the notches 79. With lever 72 positioned accordingly, flange 77 is rotatably locked at axis 97. Accordingly, attachment bracket 83 is also rotatably locked at main body 64. Lever end 73 may be grasped by a user and raised in a direction of axis 96 so as to free notch 79 and allow flange 77 to be rotated to provide a corresponding rotation of bracket 83 about axis 97.

Figure 6:
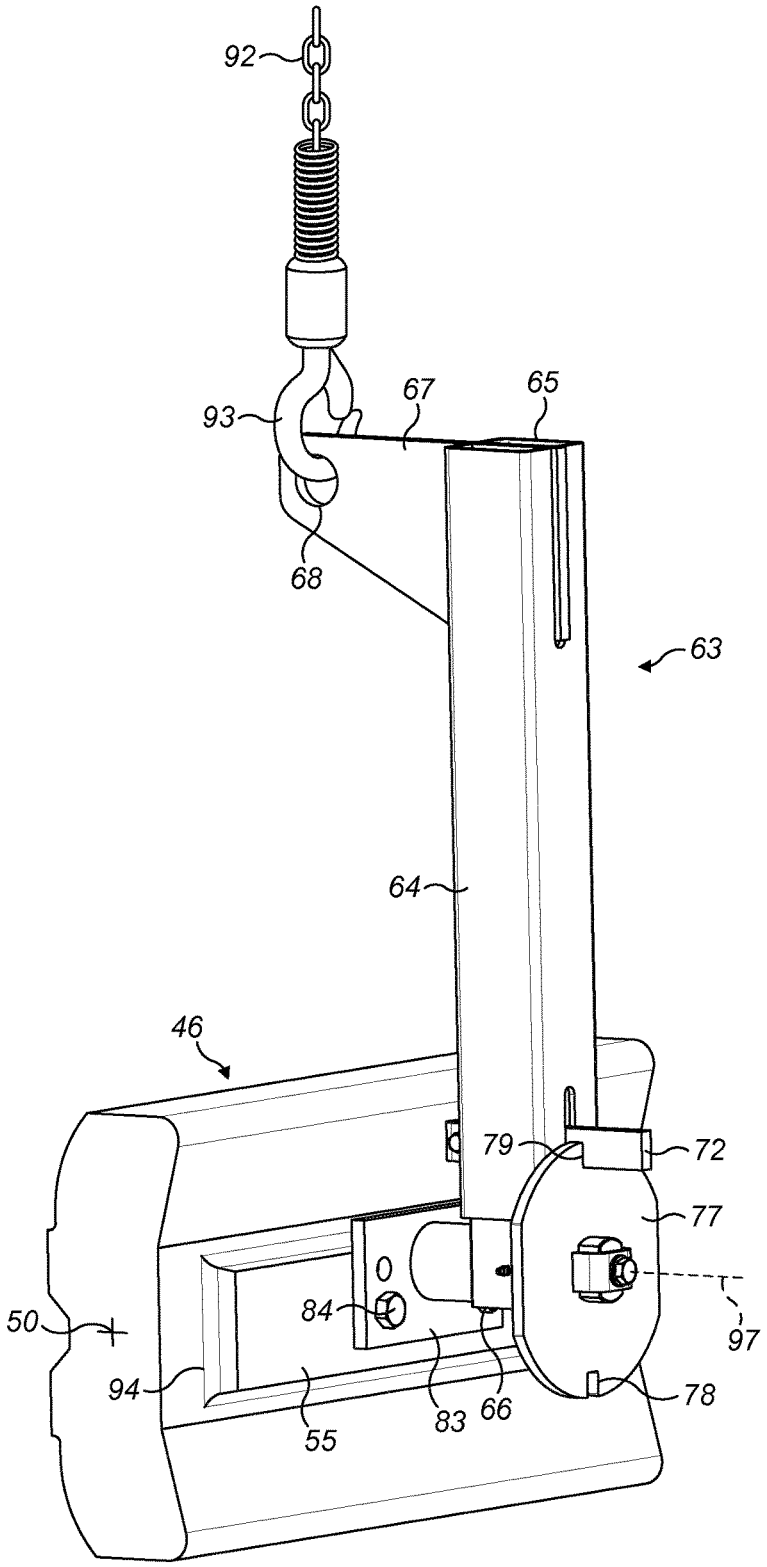
FIG. 6 is a perspective view of the lifting device of FIG. 5 suspended from an auxiliary lifting tool and mounting the hammer element of FIG. 3 according to a specific implementation of the present invention.

FIG. 6 illustrates lifting device 63 suspended from a chain 92 of an auxiliary lifting tool such as a crane (not shown). A lowermost end of chain 92 comprises an attachment coupling 93 configured to engage eyelet 68 and suspend device 63 from the lifting crane. Hammer element 46 is demountably attachable to lifting device 63 via attachment bracket 83 engaging the contact surface 55 of mount projection 94. In particular, element 46 is releasably secured to device 63 via a pair of mounting bolts 84 provided through one of the pairs of holes 85, 91 that engage into the hammer bores 56 as hammer element 46 is mated against bracket mount face 100. FIG. 6 illustrates the mounting of a non-symmetrical element 46 via the second pair of holes 91 that are positioned off-centre (in the widthwise direction) of bracket 83. Each bolt 84 is mated into the respective threaded bore 56 so as to releasably secure element 46 to device 63.

A length of axle mount 86 in a direction of axis 97 is configured such that element 46 is suspended on an axis extending through chain 92 (that bisecting eyelet 68) such that the elongate tubular main length 64 is suspended substantially vertically. Element 46 is held below coupling 93 and fin 67 by substantially the full length of main body 64 so as to allow unhindered rotation of element 46 about axis 97 when suspended from the auxiliary lifting tool. That is, with lever 72 raised to a non-engaging position within slot 71, a user may grasp flange 77 so as to rotate it about axis 97 providing a corresponding rotation of element 46 about axis 97. Element 46 may be locked in two different rotational positions corresponding to the engagement of each respective notch 78, 79 by lever 72.

So as to ensure the mass centre of element 46 is generally coaxial with axis 97, element 46 may be mounted at different positions relative to device 63 via the use of either set of bolt mounting holes 85, 91.

The invention claimed is:

1. A crusher hammer lifting device arranged to facilitate raising and lowering of a hammer mountable at a rotor of a horizontal shaft impact crusher, the lifting device comprising:

a main body having a first end and a second end;

a mount engager positioned at or towards the first end of the main body to engage and suspend the device from a lifting tool;

a hammer attachment positioned at or towards the second end of the main body to releasably attach the hammer to the device;

an axle rotatably mounting the attachment at the main body such that the hammer when attached to the device, may be rotated about an axis of the axle relative to the main body; and a lock mechanism movably mounted at or towards the second end of the main body to lock the axle and the attachment in a non-rotatable fixed position at the main body, wherein the lock mechanism includes a flange extending radially outward from the axle, the attachment being provided at one side of the main body and the flange being provided at an opposite side of the main body.

2. The device as claimed in claim 1, wherein the main body is elongated and the axis of the axle is aligned transverse and perpendicular to a length of the main body.

3. The device as claimed in claim 1, wherein the lock mechanism includes a lever pivotally mounted at the main body to engage in touching contact at least a part of the flange so as to rotatably lock the axle—and the attachment at the main body.

4. The device as claimed in claim 3, wherein the flange includes a plate like body having at least a first pair of notches recessed into a perimeter of the flange, the lever being pivotally mounted to releasably engage one of the notches to rotatably lock the axle and the attachment at at least two rotational positions.

5. The device as claimed in claim 4, wherein the notches are positioned at diametrically opposite regions of the flange.

6. The device as claimed in claim 3, wherein the lever is elongated and has a first end and a second end, the first end of the lever being mounted at one side of the main body via a pivot mount such that the second end of the lever extends through the main body to project laterally at an opposite side of the main body.

7. The device as claimed in claim 1, wherein the mount engager comprises any one of an eyelet formed within a fin extending laterally from one side of the main body; a hook extending laterally from one side of the main body; and a projection extending laterally from one side of the main body.

8. The device as claimed in claim 1, wherein the attachment comprises a plate like body mounted at one end of the axle and having at least a pair of holes receive bolts for attaching the hammer to the attachment.

9. The device as claimed in claim 8, further comprising at least a first pair of holes-for mounting the hammer at a first position at the attachment and at least a second pair of holes for mounting the hammer at a second position at the attachment.

10. The device as claimed in claim 1, wherein the main body includes an axle mount at or towards the second end of the main body to receive and rotatably mount the axle and the attachment at the main body.

11. The device as claimed in claim 1, further comprising a crusher hammer releasably attached to the device, the hammer including a plurality of threaded bore holes arranged to receive attachment bolts releasably mounting the hammer to the attachment.

12. The device as claimed in claim 11, wherein the hammer includes a pair of threaded bore holes and the attachment includes two mounting positions for the hammer.

* * * * *